US006123602A

United States Patent [19]

Rodriguez et al.

[11] Patent Number: 6,123,602

[45] Date of Patent: Sep. 26, 2000

[54] PORTABLE SLURRY DISTRIBUTION SYSTEM

[75] Inventors: Jose O. Rodriguez; Kurt Stetzler, both of Orlando, Fla.

[73] Assignee: Lucent Technologies Inc., Murray Hill, N.J.

[21] Appl. No.: 09/126,985

[22] Filed: Jul. 30, 1998

[51] Int. Cl.[7] ..... B24B 51/00; B24B 1/00

[52] U.S. Cl. ..... 451/5; 451/41; 451/60; 451/446

[58] Field of Search ..... 451/5, 41, 53, 451/60, 446; 216/88, 89; 438/692, 693

[56] References Cited

U.S. PATENT DOCUMENTS 4,059,929 11/1977 Bishop ..... 451/60
5,545,074 8/1996 Jacobs ..... 451/40
5,695,385 12/1997 Bachand et al. ..... 451/38
5,800,251 9/1998 Nakazato et al. ..... 451/41
5,857,893 1/1999 Olsen et al. ..... 451/5
5,957,759 9/1999 Cardenas et al. ..... 451/60

*Primary Examiner*—Timothy V. Eley
*Attorney, Agent, or Firm*—Stroock & Stroock & Lavan LLP

[57] ABSTRACT

A portable slurry distribution system comprising a first liquid tank containing a first liquid; a second liquid tank containing a second liquid; the first and the second liquid tanks being fluidly connected to a product mixing tank for receiving and mixing the first and the second liquids into a slurry; the product mixing tank being fluidly connected to a valve box having a valve for receiving the slurry; a means connected to the valve for distributing the slurry to a tool; and wherein the first liquid tank, the second liquid tank and the product mixing tank are on a wheeled cart.

8 Claims, 6 Drawing Sheets

PORTABLE SLURRY DISTRIBUTION SYSTEM

FIELD OF THE INVENTION

This invention relates to a portable slurry distribution system, and in particular, to a portable slurry distribution system for a CMP.

BACKGROUND OF THE INVENTION

Present slurry distribution systems are generally fixed, permanent distribution systems that feed several CMP machines. The system is complex and expensive. When the system fails or breaks down, all CMP's connected to it need to be shut down as well until the system is repaired. Also, because the prior art system feeds numerous CMP's simultaneously, it is difficult, costly and time consuming to flush the system out when it is necessary to change the slurry mixture.

The present invention overcomes the deficiencies of the prior art by providing a portable slurry distribution system.

SUMMARY OF THE INVENTION

The present invention is directed to a portable slurry distribution system. The smaller size and portability of the present invention system overcomes the deficiencies in the prior art. Given its smaller size and portability, the system is easily and quickly flushed out to permit different slurry mixtures to be delivered to different CMP's. The system also permits different slurry mixtures to be delivered to the same CMP quickly and easily, which aids in experimenting to achieve the best slurry mixture. Depending on the number of CMP's to be serviced, a company could purchase one portable slurry system for each CMP, or, if there already exists a prior art fixed system, the company could purchase a portable system as a backup to the prior art fixed system. If more than one portable system is purchased and one of the portable systems fail, then another portable system can be up and running quickly without having to shut down the CMP for an extended period of time.

In a preferred embodiment, the present invention comprises a wheeled cart configured to dispense and mix two liquids automatically in predetermined proportion. That is, the system is preferably automated through the use of a computer and process logic controls (PLC) to automatically dispense the correct predetermined amounts of each liquid from drums or onboard supply tanks to a product tank where the liquids are controllably mixed into the slurry which is then ready to be dispensed to the CMP.

In another preferred embodiment, the invention is not automated but instead comprises commercially available equipment attached to a wheeled cart and configured to permit the manual mixing of two liquids in the right proportion. That is, a technician manually adds the correct proportions of liquids to the product tank and then manually initiates the mixing of the liquids into the slurry mixture which is then ready to be dispensed to the CMP.

Other objects and features of the present invention will become apparent from the following detailed description, considered in conjunction with the accompanying drawing figures. It is to be understood, however, that the drawings, which are not to scale, are designed solely for the purpose of illustration and not as a definition of the limits of the invention, for which reference should be made to the appended claims.

DESCRIPTION OF THE DRAWING FIGURES

In the drawing figures, which are not to scale, and which are merely illustrative, and wherein like reference numerals depict like elements throughout the several views.

DETAILED DESCRIPTION OF THE PREFERRED EMBODIMENTS

Figure 1A:
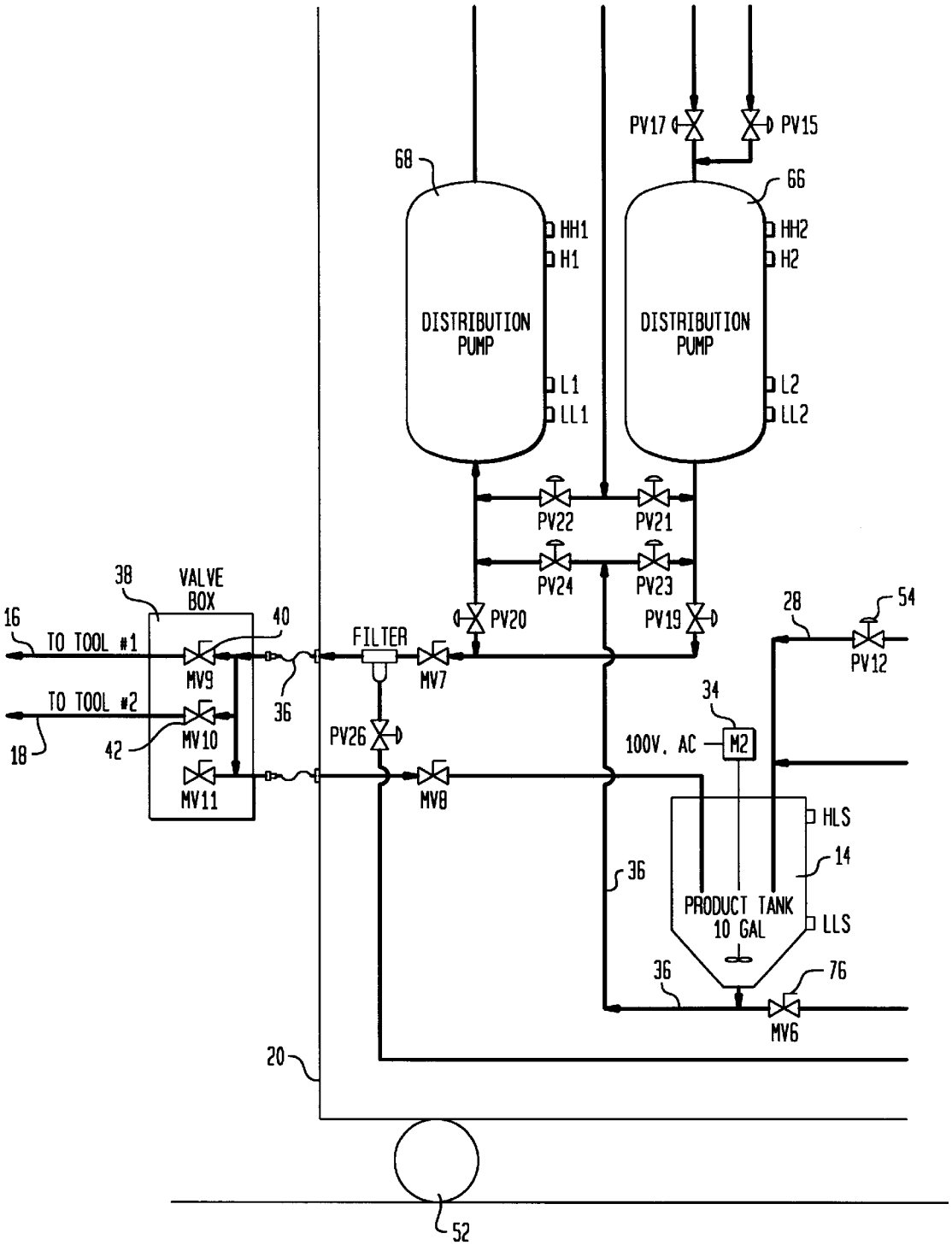
FIG. 1 is a schematic diagram of the portable slurry distribution system constructed in accordance with a preferred embodiment of the present invention.
Figure 1B:
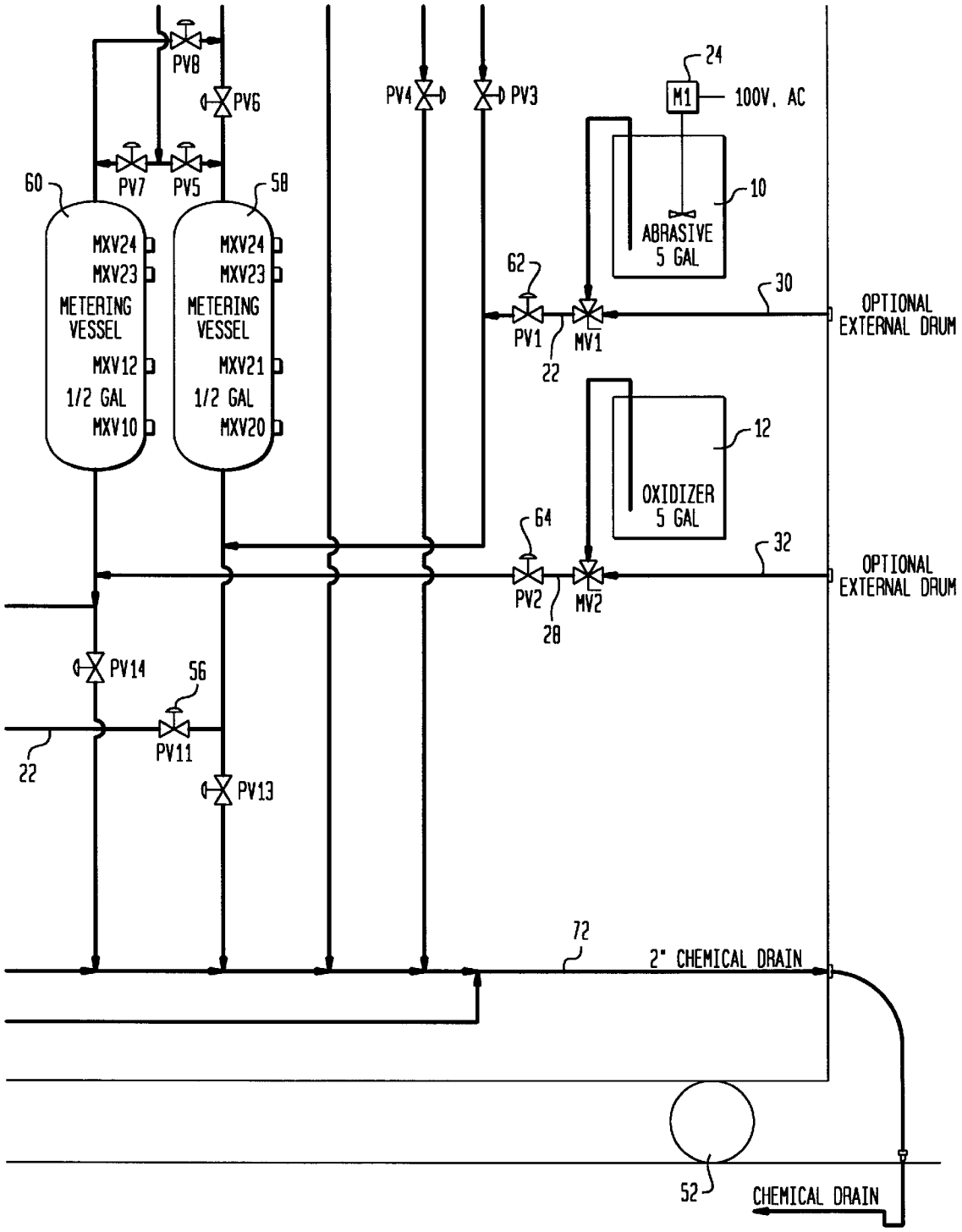
Figure 1C:
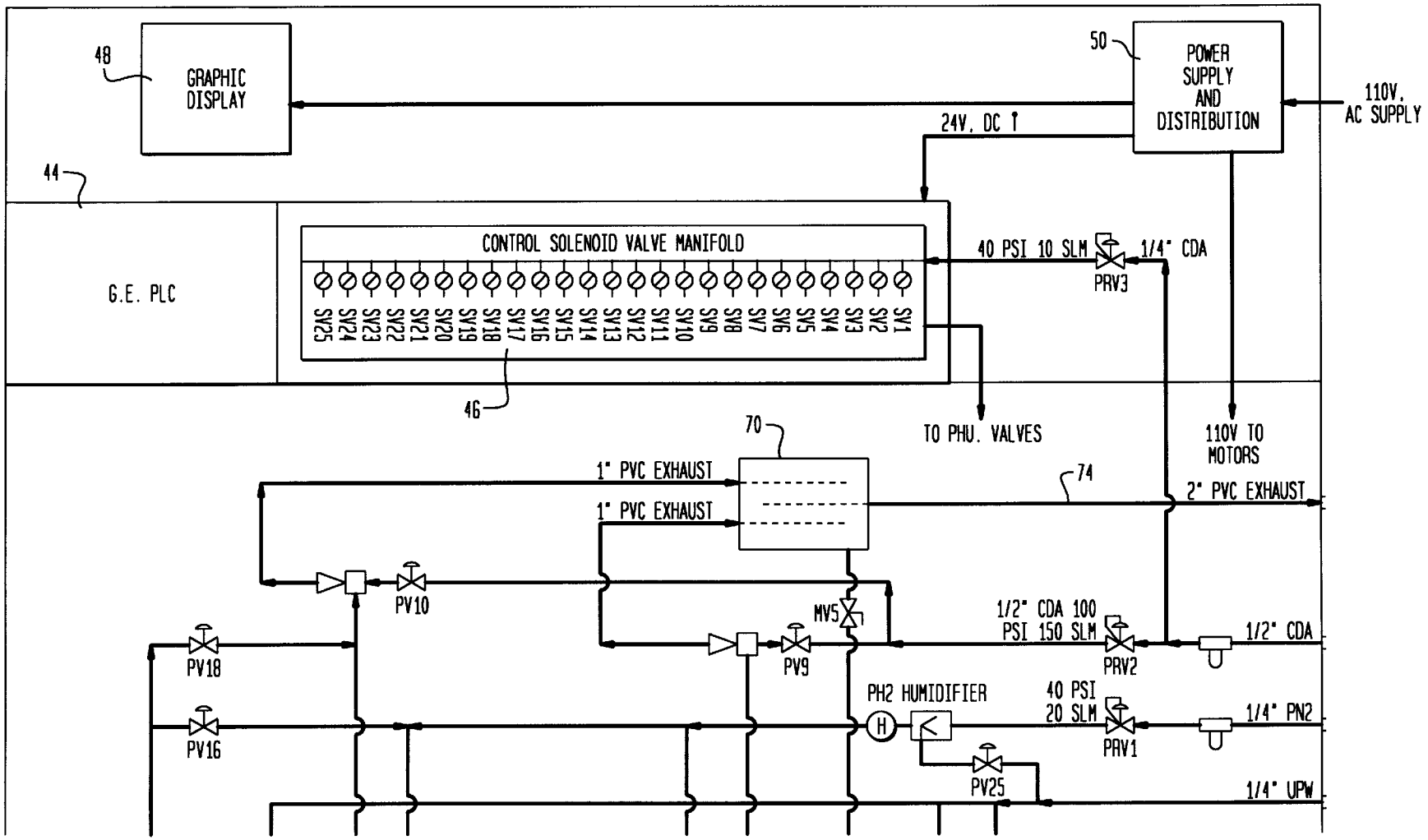
Figure 2:
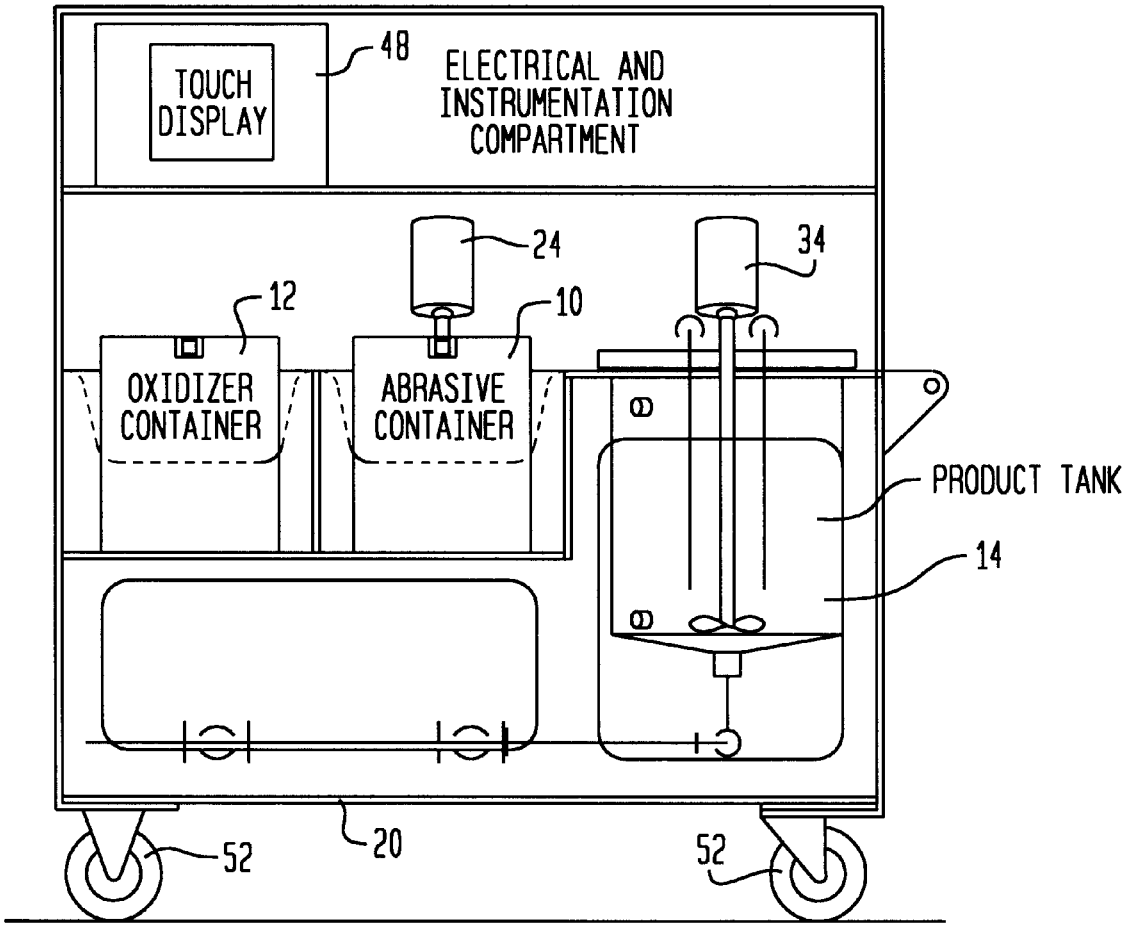
FIG. 2 is a front cutaway view of the portable slurry distribution system constructed in accordance with a preferred embodiment of the present invention.
Figure 3:
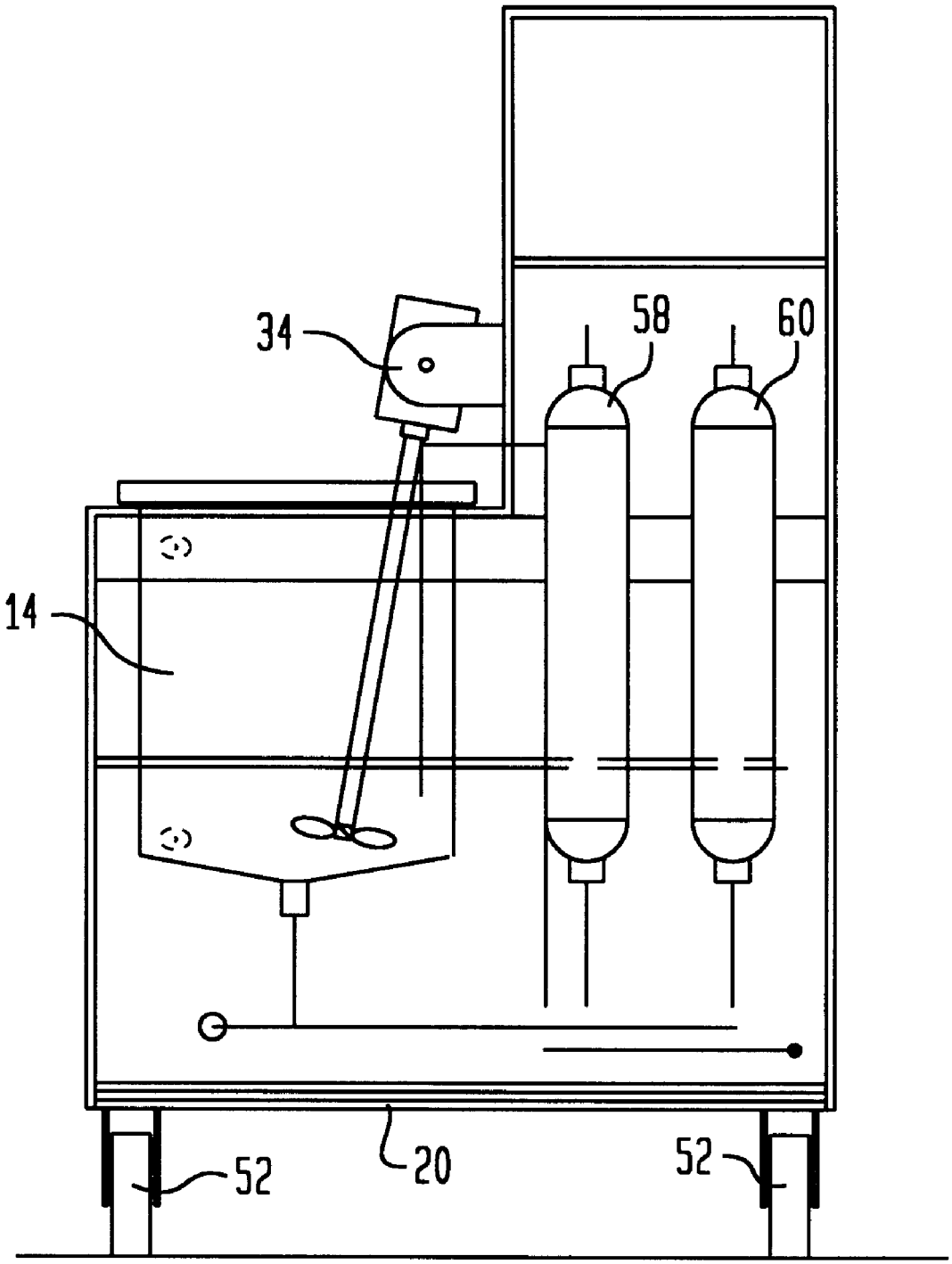
FIG. 3 is a side cutaway view of the portable slurry distribution system constructed in accordance with a preferred embodiment of the present invention.
Figure 4:
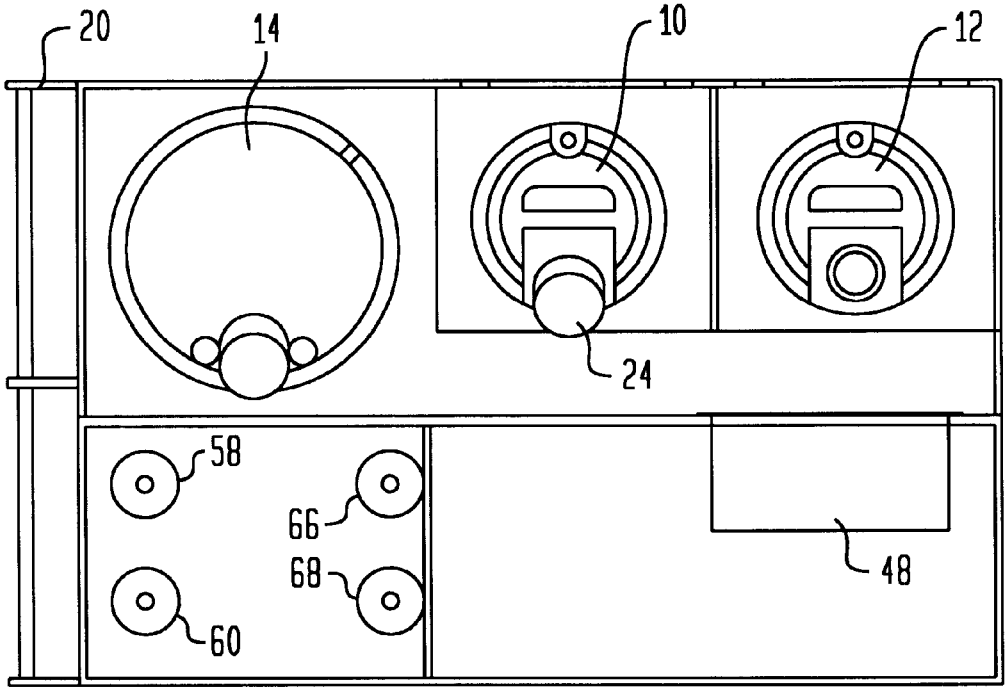
FIG. 4 is a top cutaway view of the portable slurry distribution system constructed in accordance with a preferred embodiment of the present invention.

FIG. 1 depicts a portable slurry distribution system constructed according to a preferred embodiment of the present invention. The system generally includes a first liquid tank 10, a second liquid tank 12, a product mixing tank 14, a first slurry distribution pipe 16 and a second slurry distribution pipe 18, with all elements being in selectable fluid communication by way pipes and valves, and with all elements being installed on a wheeled cart 20.

As seen in FIG. 1, the system is directed at portably mixing and distributing a two-part liquid slurry of a type used in CMP. A first liquid, such as by way of a non-limiting example, an art-recognized abrasive, is manually poured into first liquid tank 10. First liquid tank 10 may also consist of an electronic mixer 24 for mixing the liquid in first liquid tank 10. First liquid tank 10 is in fluid communication with product tank 14 via pipe 22. A second liquid, such as by way of a non-limiting example, an art-recognized oxidizer, is manually poured into second liquid tank 12. Second liquid tank 12 is fluidly connected to product tank 14 via pipe 28. In a preferred embodiment, pumps are provided to pump the first and second liquids to product tank 14. In an alternative embodiment, the first and second liquids are gravity fed to the product tank 14. Also, in an alternative embodiment, first liquid tank 10 may be connected to an external drum (not shown) via pipe 30, and second liquid tank 12 may be connected to an external drum (not shown) via pipe 32. The external drums, if so provided, serve to facilitate automated filling of greater quantities of material into liquid tanks 10 and 12.

In a preferred embodiment, first liquid tank 10 is fluidly connected to a first metering vessel 58 via pipe 22, and second liquid tank 12 is fluidly connected to a second metering vessel 60 via pipe 28. The metering vessels are fluidly connected to a silencer 70 which provides an exhaust path along pipe 74. Valve 62 is installed along pipe 22 between first liquid tank 10 and first metering vessel 58 for controlling the amount of first liquid being supplied to first metering vessel 58. Valve 64 is installed along pipe 28 between second liquid tank 12 and second metering vessel 60 for controlling the amount of second liquid being supplied to second metering vessel 60. The first liquid is pumped through pipe 22 into first metering vessel 58. First metering vessel 58 stores the first liquid until such time as it is to be delivered to product tank 14 through pipe 22. The second liquid is pumped through pipe 28 into second metering vessel 60. Second metering vessel 60 stores the second liquid until such time as it is to be delivered to product tank 14 through pipe 28. Valve 56 is installed between first metering vessel 58 and product tank 14 along pipe 22 for controlling the amount of the first liquid being dispensed to product tank 14. Valve 54 is installed between second metering vessel 60 and product tank 14 along pipe 28 for controlling the amount of the second liquid being dispensed to product tank 14.

Product tank 14 has an electronic mixer 34 for mixing the first and second liquids into a slurry. Product tank 14 also has a chemical drain 72 which is controlled by valve 76. After mixing, the slurry is sent via pipe 36 to valve box 38. A first distribution pump 66 and second distribution pump 68 are provided for pumping the slurry to valve box 38. The distribution pumps may be, by way of a non-limiting example, pressure vacuum engines, or the like. The distribution pumps are fluidly connected to a silencer 70 which provides an exhaust path along pipe 74. Valve box 38 consists of first distribution valve 40 for operating first slurry distribution pipe 16 and second distribution valve 42 for operating second slurry distribution pipe 18. Thus, at valve box 38, the slurry is sent to either the first slurry distribution pipe 16 and/or a second slurry distribution pipe 18 to be distributed to a first and/or second CMP (not shown). One of skill in the art will recognize that valve box 38 may consist of any number of distribution valves and pipes whereby one portable slurry machine can service any number of CMP's.

In a preferred embodiment, the valves, mixers, metering vessels and any necessary pumps for pumping the first and second liquids or the slurry mixture are controlled by a computer 44 to provide for automated operation. That is, computer 44 controls a control solenoid valve manifold 46 for automating the distribution and mixing of the liquids. For example, control solenoid valve manifold 46 controls the opening and closing of valve 62 for automatically dispensing the correct amount of the first liquid from supply tank 10 to first metering vessel 58, and control solenoid valve manifold 46 controls the opening and closing of valve 64 for automatically dispensing the correct amount of the second liquid from supply tank 12 to second metering vessel 60. Control solenoid valve manifold 46 also controls valves 56 and 54 for automatically dispensing the correct amount first and second liquids from first and second metering vessels to product tank 14. Control solenoid valve manifold 46 in turn also controls mixer 34 for mixing the liquids for the appropriate period of time at the appropriate speed to produce the slurry to be sent to valve box 38. In a preferred embodiment, computer 44 may also consist of a graphic display 48 for graphically displaying the steps as they are carried out or to display any maintenance or repairs that may be required on the system. Computer 44, and all other electrical equipment, is electrically connected to a power supply and distribution junction box 50 which in turn is connected to a 110 volt AC supply via an extension cord or the like (not shown). The system also includes all necessary pumps and piping equipment for pumping the liquids and slurry both throughout the system and to the CMP's.

Cart 20 is generally of any sufficient size to accommodate the required equipment while at the same time being manually portable, i.e., being maneuverable by the ordinary technician. Cart 20 generally includes a flat lower platform with wheels 52 underneath. Cart 20 may have three or more wheels, wherein the front wheel or wheels are caster-type wheels to aid in maneuvering the cart, or the cart may glide on gliders or sleds or tracks. In an alternative embodiment, cart 20 may consist of a drive means for maneuvering cart 20 if the components contained thereon become to heavy or cumbersome to move manually. Such drive means may be any art-recognized means of driving and/or steering a mobile cart, such as, for example, an electric, battery or gas driven motor or external vehicle or tractor, and the like.

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirit of the invention. It is the intention, therefore, to be limited only as indicated by the scope of the claims appended hereto.

What is claimed is:

1. A method of chemo-mechanically polishing a semiconductor wafer comprising the steps of:

(a) placing a wafer to be polished in a polishing tool;

(b) providing a first liquid to a first cart-mounted liquid tank;

(c) providing a second liquid to a second cart-mounted liquid tank;

(d) mixing said first liquid and said second liquid in a cart-mounted product mixing tank to form a slurry;

(e) positioning said cart proximate said tool;

(f) delivering said slurry to said tool; and (g) polishing said wafer using said tool.

2. The method according to claim 1 further comprising the step of passing said slurry through a valve box prior to delivering said slurry to said tool.

3. The method according to claim 2 further comprising the step of passing said slurry through a distribution pump fluidly connected between said valve box and said product mixing tank.

4. The method according to claim 2 further comprising the step of controlling said valve box via a control solenoid valve manifold.

5. The method according to claim 4 further comprising the step of controlling said control solenoid via a computer.

6. The method according to claim 2 wherein said cart is positioned proximate said tool via a drive means.

7. The method according to claim 1 further comprising the step of passing said slurry through a metering vessel located between said first or said second liquid tanks and said product mixing tank.

8. A method of manufacturing an integrated circuit comprising the steps of:

(a) placing a wafer to be polished in a polishing tool;

(b) providing a first liquid to a first cart-mounted liquid tank;

(c) providing a second liquid to a second cart-mounted liquid tank;

(d) mixing said first liquid and said second liquid in a cart-mounted product mixing tank to form a slurry;

(e) positioning said cart proximate said tool;

(f) delivering said slurry to said tool;

(g) polishing said wafer using said tool; and (h) forming an integrated circuit on said wafer.

* * * * *